US006905403B2

(12) United States Patent
Stallegger et al.

(10) Patent No.: US 6,905,403 B2
(45) Date of Patent: Jun. 14, 2005

(54) KNIFE-SHARPENING MACHINE

(75) Inventors: Harald Stallegger, Rupertgasse 5, A-5020 Salzburg (AT); Alois Spreitz, Bergheim (AT)

(73) Assignee: Harald Stallegger, Salzburg (AU)

( * ) Notice: Subject to any disclaimer, the term of this patent is extended or adjusted under 35 U.S.C. 154(b) by 60 days.

(21) Appl. No.: 10/399,725

(22) PCT Filed: Oct. 10, 2001

(86) PCT No.: PCT/EP01/11695

§ 371 (c)(1),
(2), (4) Date: Apr. 18, 2003

(87) PCT Pub. No.: WO02/34470

PCT Pub. Date: May 2, 2002

(65) Prior Publication Data

US 2004/0014415 A1 Jan. 22, 2004

(30) Foreign Application Priority Data

Oct. 23, 2000 (DE) ..... 100 52 439

(51) Int. Cl.[7] ..... B23F 21/03

(52) U.S. Cl. ..... 451/555; 451/45; 451/463; 451/470; 451/484; 451/485; 451/486

(58) Field of Search ..... 451/45, 463, 470, 451/484, 485, 486, 502, 555

(56) References Cited

U.S. PATENT DOCUMENTS

| | | | | |
|---|---|---|---|---|
| 2,435,672 A | | 2/1948 | Clark | |
| 4,624,079 A | * | 11/1986 | Bonapace | 451/555 |
| 4,934,110 A | * | 6/1990 | Juranitch | 451/486 |
| 5,040,435 A | | 8/1991 | Millman | |
| 5,478,272 A | | 12/1995 | Cozzini et al. | |

* cited by examiner

*Primary Examiner*—Joseph J. Hail, III
*Assistant Examiner*—Shantese McDonald
(74) *Attorney, Agent, or Firm*—Flynn, Thiel, Boutell & Tanis, P.C.

(57) ABSTRACT

The invention relates to a knife sharpening machine comprising a plate-type holding device on which two intersecting sharpening bars are rotationally mounted and loaded in relation to each other by means of springs. The sharpening bars, at least in the grinding area, are made of a ceramic material. The plate is provided with a slit which is open on one end and closed on the other, extending as far as the intersection point of the sharpening bars. When pressure is exerted by the knife in the direction of the closed slit end, the sharpening bars are spread apart from each other counter to the force of the springs. Curved guides are provided on both sides of the slit. The ends of the sharpening bars, facing away from the axes of rotation thereof, are guided therein.

14 Claims, 2 Drawing Sheets

KNIFE-SHARPENING MACHINE

This invention relates to a knife sharpening apparatus having a holding device on which two intersecting sharpening rods are pivotally mounted and loaded toward each other by springs, the holding device having a slot open at the end facing away from the rotation axes of the sharpening rods and closed at the end facing the rotation axes of the sharpening rods, said slot extending to the intersection point of the sharpening rods so that upon pressure of the knife on the intersecting sharpening rods in the direction of the closed end of the slot the sharpening rods are spread apart against the force of the springs.

Such an apparatus is known from U.S. Pat. No. 5,478,272. The sharpening rods are made of steel. The springs swiveling the sharpening rods toward each other are constituted by coil springs acting on the rotation axes of the sharpening rods. The grinding power of the known apparatus leaves something to be desired. Also, the known apparatus is difficult to clean since when unclean knives are sharpened liquid debris can pass into the area of the rotation axes with the coil springs.

The problem of the invention is to decisively improve the known apparatus in terms of grinding power and hygiene.

This is obtained according to the invention by the measures stated in claim 1.

Sharpening rods are thus used according to the invention that are made of ceramics at least in the grinding area. This achieves high grinding power. Ceramic materials to be used are in particular oxides, carbides, borides, nitrides or silicides of metals or of the nonmetals with each other, for example silicon carbide, or metal oxides, metal carbides, metal borides, metal nitrides or metal silicides in particular of tungsten, titanium, niobium or tantalum, for example tungsten carbide. Such metal compounds are also referred to as hard metals. Since ceramic rods withstand only little bending stress, the sharpening rods are guided according to the invention at the ends facing away from their rotation axes in guides formed in an arc shape with a radius corresponding to the length of the rods.

To shorten the grinding time due to a long grinding surface, the two sharpening rods preferably have according to the invention a rectangular cross section at least in the grinding area, the opposing sides of the two rectangles extending parallel to each other. Thus the knife touches the full width of the two sharpening rods during grinding. That is, at a width of the sharpening rods of for example 0.5 to 1 centimeter the knife is in contact with the sharpening rods over a length of 1 to 2 centimeters during grinding.

The ceramic material in the grinding area can also be formed by an insert in the sharpening rods.

Sharpening of knives causes material to be removed substantially evenly over the length of the sharpening rods. However, this does not apply to the portion of the sharpening rods at the closed end area of the slot. Here, a step forms in the ceramic rods in the course of time, which can lead to the knife becoming blunt instead of sharp during grinding.

To remedy this, the two sharpening rods preferably have according to the invention on the opposing sides a portion tapering toward the rotation axis of the rod in the closed end area of the slot. Said tapering portions can be formed for example by constrictions of the sharpening rods in this area.

The sharpening rods are preferably each fastened to a pin pivotally mounted on the holding device.

The springs swiveling the sharpening rods toward each other can be formed by torsion bars extending on each side of the slot and fastened at one end rotationally fast to the pin and at the other end on the same side of the slot to the holding device. The springs are thus readily accessible from outside and easy to clean. The torsion bars can be formed for example by a leaf spring or spring wire.

The holding device is preferably constituted by a plate, the curved guides for the sharpening rods being constituted by curved slots in the plate. For guidance in the curved guides of the plate, the sharpening rods each have at the end facing away from the rotation axis a pin on which a portion with reduced diameter is provided for engaging the relevant guide slot.

The pins for pivotally mounting the sharpening rods can likewise have a portion with reduced diameter for engaging a bore in the plate. The pins for pivotally mounting the rods and/or the pins for guiding the rods are preferably made of plastic and are provided with receiving means in which the ends of the rods are inserted. The ceramic rods inserted into the plastic pins are thus soft mounted. The receiving means have a cross section corresponding to the sharpening rods, thus being likewise rectangular if the rods have a rectangular cross section.

On the other side of the plate there is a counterpart connectable with the particular pin and having a larger diameter than the portion with reduced diameter. For connecting the counterpart with the pin, a plug connection or snap connection can be provided for example. However, the connection is preferably formed by a screw connection. This can be so designed e.g. that the counterpart is formed as a screw that is screwed into an internal thread provided in the portion of the pin with reduced diameter. Conversely, the counterpart can be formed as a nut that is screwed onto a screw thread provided on the portion of the pin with reduced diameter.

All four pins and all four counterparts for mounting and guiding the rods can be of identical form, whereby, since the rods are offset from the holding device or holding plate, the distance of the receiving means from the plate is smaller in the case of the two pins receiving the rod offset from the plate than in the case of the two other pins.

On the outside of the rods facing away from the grinding surface, a plate-shaped finger guard is mounted on each rod to prevent one's hand from coming in contact with the knife if the holding device is held with the hand during grinding.

In the following, an embodiment of the inventive knife grinding apparatus will be explained in more detail by way of example with reference to the drawing, in which.

Figure 1:
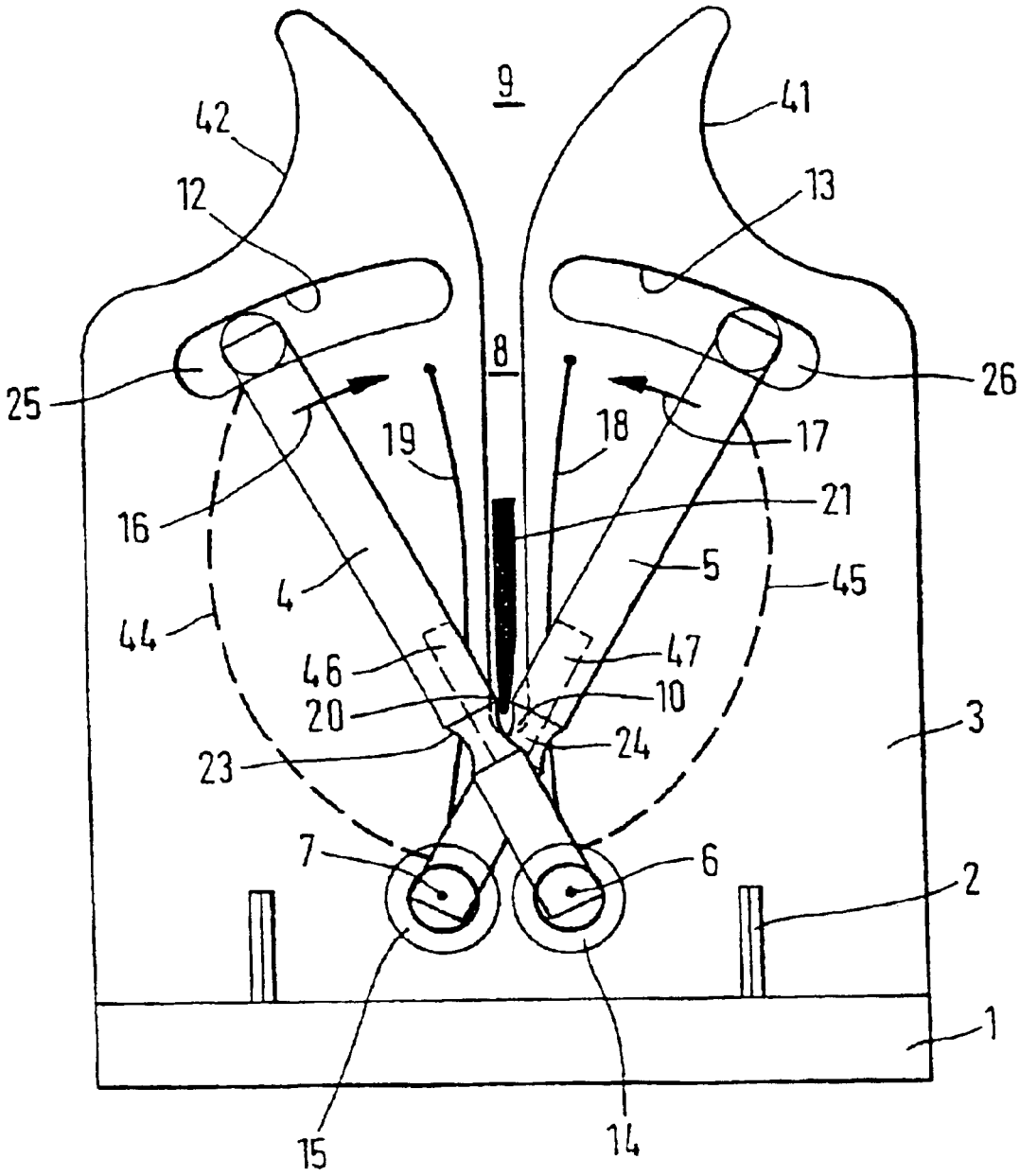
FIG. 1 and FIG. 2 show front and side views of the inventive apparatus.
Figure 2:
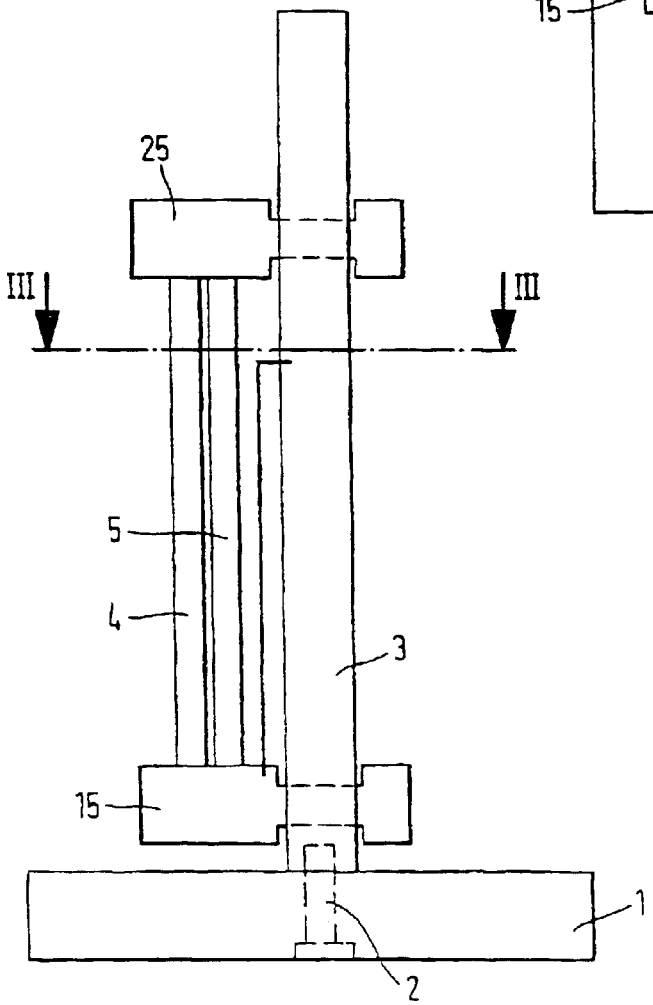

According to FIGS. 1 and 2, the apparatus has holding plate 3 fastened with screws 2 on plate-shaped pedestal 1.

Holding plate 3 has pivotally mounted thereon two intersecting sharpening rods 4, 5 with axes 6, 7 extending perpendicular to plate 3. In the middle, holding plate 3 has vertical slot 8 that is open at upper end 9 bell mouthed upward, and closed at lower end 10. Lower end 10 is located above two rotation axes 6, 7 located on one and the other side of the perpendicular to slot 8.

So that sharpening rods 4, 5 can intersect, they are offset from plate 3. That is, rod 5 is disposed closer to plate 3 than rod 4. Rods 4, 5 extending parallel to holding plate 3 are made of ceramics, for example silicon carbide. At the upper end facing away from rotation axes 6, 7, rods 4, 5 are guided in holding plate 3 in curved slots 12, 13 extending on one and the other side of slot 8.

Rods 4, 5 are fastened to pins 14, 15 pivotally mounted on holding plate 3. The ends of rods 4, 5 are loaded toward each other in accordance with arrows 16, 17 by torsion bars 18, 19 extending on either side of slot 8 and fastened at one end rotationally fast to pin 14, 15 and at the other end bent and inserted into corresponding bores in plate 3.

Slot 8 serving to receive and guide a knife with blade 21 to be sharpened extends to intersection point 20 of spread-apart rods 4, 5. That is, the pressure of the knife or blade 21 in the direction of closed end 10 of the slot spreads apart rods 4, 5 against the force of springs 18, 19, as shown in FIG. 1.

Figure 3:
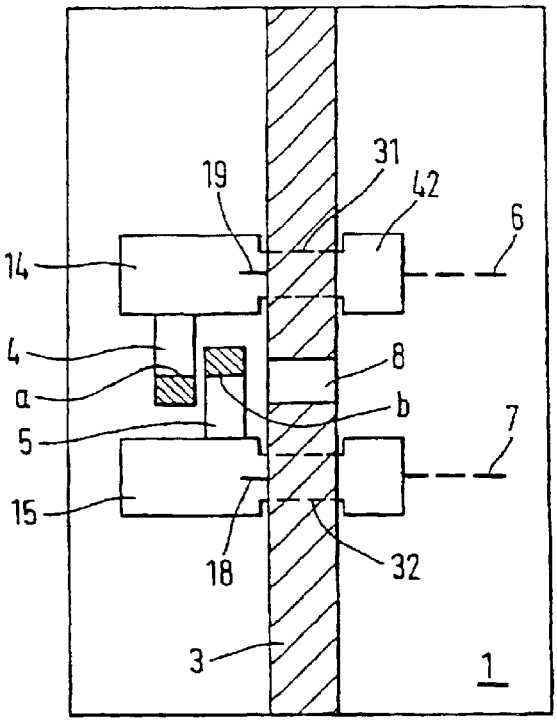
FIG. 3 shows a section along line III—III in FIG. 2.

As to be seen in FIG. 3, ceramic rods 4, 5 have a square or rectangular cross section, whereby opposing sides a, b of the two rectangles extend parallel to each other. A triangular cross section is also possible, however, in which case the opposing sides of the two triangles extend parallel, or, in general, the two opposing sides of the two polygons if rods 4, 5 have a polygonal cross section.

Rods 4, 5 are worn out by sharpening knives in the course of time. A step can thereby develop in lower end area 10 of slot 8 in the course of time. To prevent the formation of such steps, rods 4, 5 have a tapering form in this area, due to constrictions 23, 24.

Figure 4:
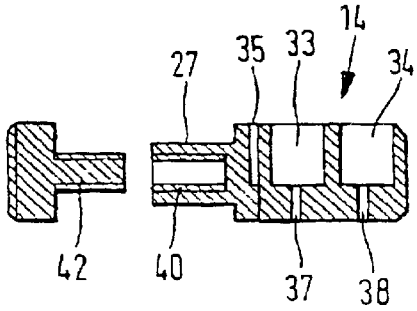
FIG. 4 shows a section through a pin adapted to be slipped onto one end of a sharpening rod for mounting or guiding the rod, with a counterpart.

For guidance in curved slots 12, 13, rods 4, 5 each have at the upper end pin 25, 26 provided with portion 27 with reduced diameter for engaging guide slot 12, 13. In the same way, pins 14, 15 each have on rotation axis 6, 7 a portion with reduced diameter for engaging bore 31, 32 in holding plate 3. Pins 14, 15 and 25, 26 are made of plastic. Since pins 14, 15 and 25, 26 are of identical form, only pin 14 is shown in FIG. 4. Pin 14 is provided with rectangular pocket-like receiving means 33, 34 in which one end of rod 4, 5 is inserted. Fine blind bore 35 of pin 14 receives the end of torsion bar 18, 19. Through bores 37, 38 moisture can escape from receiving means 33, 34. Portion 27 with reduced diameter has internal thread 40 in which cap screw 42 is screwed as a counterpart. Unused receiving means 33 or 34 can be closed.

In upper area 9 of slot 8, plate 3 has lateral gaps 41, 42.

According to FIG. 1, rods 4, 5 each have on the outside curved plate 44, 45, shown by dashed lines, as a finger guard for example made of plastic, said plates extending parallel to holding plate 3 and being axially offset. Further, inserts 46, 47 shown by dashed lines in FIG. 1 are provided in the grinding area of rods 4, 5 and made of ceramics. If such ceramic inserts 46, 47 are used, constrictions 23, 24 can be omitted. Apart from inserts 46, 47, rods 4, 5 can then be made of plastic for example. Also, it is then possible to form rods 4, 5 integrally with finger-guard plates 44, 45.

What is claimed is:

1. A knife sharpening apparatus having a holding device on which two intersecting sharpening rods are pivotally mounted and loaded toward each other by springs, said holding device having a slot open at one end and closed at the other end and extending to an intersection point of the sharpening rods so that upon pressure of a knife in the slot in the direction of the closed end of the slot the sharpening rods are spread apart against the force of the springs, wherein the sharpening rods are made of ceramics at least in a grinding area, and curved guides are provided on each side of the slot for guiding ends of the sharpening rods facing away from their rotation axes.

2. A knife sharpening device according to claim 1, wherein the two sharpening rods have a polygonal cross section, opposing sides of the two polygons extending parallel to each other.

3. A knife sharpening device according to claim 1, wherein the two sharpening rods have on opposing sides a portion tapering toward the rotation axes in a closed end area of the slot.

4. A knife sharpening device according to claim 1, wherein the ceramics consists of silicon carbide or tungsten carbide.

5. A knife sharpening device according to claim 1, wherein the holding device is fastened to a base.

6. A knife sharpening device according to claim 1, wherein the sharpening rods are each fastened to a respective pin pivotally mounted on the holding device.

7. A knife sharpening device according to claim 6, wherein the springs swiveling the sharpening rods toward each other are formed by torsion bars extending on either side of the slot and fastened at one end rotationally fast to the respective pin and at the other end to the holding device.

8. A knife sharpening apparatus according to claim 6, wherein the pins for pivotally mounting the sharpening rods and a second pair of pins for guiding the sharpening rods are formed of plastic and have receiving means for insertion of the ends of the sharpening rods.

9. A knife sharpening device according to claim 1, wherein the holding device is formed by a plate and the curved guides constitute curved guide slots in the plate.

10. A knife sharpening device according to claim 9, wherein each said sharpening rod is provided for guidance in the respective curved guide slot at the end facing away from the respective rotation axis with a second pin having a portion with reduced diameter for engaging the guide slot.

11. A knife sharpening apparatus according to claim 9, wherein the pins for pivotally mounting the sharpening rods have a portion with reduced diameter for engaging a respective bore in the plate.

12. A knife sharpening apparatus according to claim 11, wherein a counterpart connectable with the pins and having a larger diameter than the portion with reduced diameter is provided on the other side of the plate.

13. A knife sharpening apparatus according to claim 9, wherein a base to which the holding plate is fastened is formed by a pedestal.

14. A knife sharpening apparatus according to claim 1, wherein the slot is bell mouthed in an open end area.

* * * * *